US006209350B1

(12) United States Patent
Kimble, III

(10) Patent No.: US 6,209,350 B1
(45) Date of Patent: Apr. 3, 2001

(54) REFRIGERATION PROCESS FOR LIQUEFACTION OF NATURAL GAS

(75) Inventor: E. Lawrence Kimble, III, Sugar Land, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 09/422,089

(22) Filed: Oct. 21, 1999

Related U.S. Application Data

(60) Provisional application No. 60/105,462, filed on Oct. 23, 1998.

(51) Int. Cl.[7] ..... F25J 1/00

(52) U.S. Cl. ..... 62/613; 62/619; 62/50.1

(58) Field of Search ..... 62/613, 619, 50.1

(56) References Cited

U.S. PATENT DOCUMENTS

| | | | |
|---|---|---|---|
| 2,958,205 | 11/1960 | McConkey | 62/54 |
| 3,298,805 | 1/1967 | Secord et al. | 48/190 |
| 3,433,026 | 3/1969 | Swearingen | 62/23 |
| 3,477,509 | 11/1969 | Arendt | 166/252 |
| 3,677,019 | 7/1972 | Olszewski | 62/9 |
| 3,724,226 | 4/1973 | Pachaly | 62/39 |
| 3,735,600 | 5/1973 | Dowdell et al. | 62/39 |
| 3,802,213 | 4/1974 | Ooka | 62/55 |
| 3,990,256 | 11/1976 | May et al. | 62/53 |
| 4,157,904 | 6/1979 | Campbell et al. | 62/27 |
| 4,192,655 | 3/1980 | von Linde | 48/191 |
| 4,315,407 | 2/1982 | Creed et al. | 62/53 |
| 4,456,459 | 6/1984 | Brundige, Jr. | 62/9 |
| 4,541,852 | 9/1985 | Newton et al. | 62/11 |
| 4,548,629 | 10/1985 | Chiu | 62/17 |
| 4,638,639 | 1/1987 | Marshall et al. | 62/9 |
| 4,687,499 | 8/1987 | Aghili | 62/24 |
| 4,698,081 | 10/1987 | Aghili | 62/24 |
| 4,718,459 | 1/1988 | Adorjan | 138/105 |
| 4,778,497 | 10/1988 | Hanson et al. | 62/11 |
| 5,036,671 | 8/1991 | Nelson et al. | 62/23 |
| 5,199,266 | 4/1993 | Johansen | 62/8 |
| 5,363,655 | 11/1994 | Kikkawa et al. | 62/9 |
| 5,372,010 | 12/1994 | Gratz | 62/87 |
| 5,442,934 | 8/1995 | Wolflick | 62/401 |
| 5,473,900 | 12/1995 | Low | 62/9 |
| 5,524,456 * | 6/1996 | Stokes | 62/48.2 |
| 5,615,561 | 4/1997 | Houshmand et al. | 62/611 |
| 5,651,269 | 7/1997 | Prevost et al. | 62/613 |
| 5,669,234 | 9/1997 | Houser et al. | 62/612 |
| 5,755,114 | 5/1998 | Foglietta | 62/618 |
| 5,802,874 | 9/1998 | Voit | 62/650 |

(List continued on next page.)

FOREIGN PATENT DOCUMENTS

| | | |
|---|---|---|
| WO 97/01069 | 9/1997 | (WO) . |
| WO 97/13109 | 10/1997 | (WO) . |

OTHER PUBLICATIONS

Bennett, C.P. Marine Transportaion of LNG at Intermediate Ttemperature, *CME* (Mar. 1979), pp. 63–64.

(List continued on next page.)

*Primary Examiner*—Ronald Capossela
(74) *Attorney, Agent, or Firm*—Gary D. Lawson

(57) ABSTRACT

A process is disclosed for conveying gas stream rich in methane, such as natural gas. In the first step of the process, gas is supplied to a pipeline at an entry pressure that is substantially higher than the output pressure of the pipeline. The drop in pressure in the pipeline causes a lowering of the gas temperature, preferably to a temperature below about −29° C. (−20° F.). The entry pressure of the gas to the pipeline is controlled to achieve a predetermined output pressure of the gas from the pipeline. Output gas from the pipeline is then liquefied to produce liquefied gas having a temperature above about −112° C. (−170° F.) and a pressure sufficient for the liquid to be at or below its bubble point temperature. The pressurized liquefied gas is then further transported in a suitable container.

22 Claims, 2 Drawing Sheets

U.S. PATENT DOCUMENTS

| | | | | |
|---|---|---|---|---|
| 5,829,269 | * | 11/1998 | Pecoud et al. | 62/48.2 |
| 5,836,173 | | 11/1998 | Lynch et al. | 62/613 |
| 5,878,814 | | 9/1999 | Breivik et al. | 166/267 |
| 5,950,453 | | 9/1999 | Bowen et al. | 62/612 |
| 5,956,971 | | 9/1999 | Cole et al. | 62/623 |

OTHER PUBLICATIONS

Broeker, R. J. CNG and MLG–New Natural Gas Transportation Processes, *American Gas Journal*, (Jul. 1969) pp.138–140.

Faridany, E. K., Ffooks R. C., and Meikle, R. B. A Pressure LNG System, European Offshore Petroleum Conference & Exhibition (Oct. 21–24, 1980), vol. EUR 171, pp. 245–254.

Faridany, E. K., Secord, H.C, O'Brien, J. V., Pritchard, J. F., and Banister, M. The Ocean Phoenix Pressure–LNG System, *Gastech 76* (1976), New York, pp. 267–280.

Fluggen, Prof. E. and Backhaus, Dr. I. H. Pressurised LNG–and the Utilisation of Small Gas Fields, Gastech78, LNG/LPG Conference (Nov. 7, 1978), Monte Carlo pp. 195–204.

Gas Processors Suppliers Association. Turboexpanders, *Engineering Data Book* (1987), vol. I, Sec. 1–16, pp. 13–40:13–41.

Lynch, J. T. and Pitman, R. N. Improving Thoughput and Ethane Recovery at GPM's Goldsmith Gas Plant, Proceedings of the Seventy–Fifth Gas Processors Association Annual Convention, (Mar. 11–13, 1996), Denver, Colorado, pp. 210–217.

Lynch, J. T. and Pitman, R. N. Texas Plant Retrofit Improves Through $C_2$ Recovery, *Oil and Gas Journal* (Jun. 3, 1996), pp. 41–48.

Maddox, R. N., Sheerar, L. F., and Erbar, J. H. Cryogenic Expander Processing, *Gas Conditioning and Processing* (Jan. 1982) vol. 3, 13–9:13–10.

Perret, J. Techniques in the Liquefaction of Natural Gas, *French Natural Gas*, (Nov. 11, 1996), pp. 1537–1539.

Petsinger, R.E. LNG on the Move, *Gas*, (Dec. 1967), pp. 45–59.

Broeker, R. J. A New Process for the Transportation of Natural Gas, Proceedings of The First International Conference on LNG (1968), Chicago, Illinois, Session No. 5, Paper 30, pp. 1–11.

Ladkany, S. G. Composite Aluminun–Fiberglass Epoxy Pressure Vessels for Transportation of LNG at Intermediate Temperature, published in Advances in Cryogenic Engineering, Materials, vol. 28, (Proceedings of the 4th International Cryogenic Materials Conference), San Diego, CA, USA, Aug. 10–14, 1981, pp. 905–913.

* cited by examiner

REFRIGERATION PROCESS FOR LIQUEFACTION OF NATURAL GAS

This application claims the benefit of U.S. Provisional Application No. 60/105,462, filed Oct. 23, 1998.

FIELD OF THE INVENTION

This invention relates generally to a process for conveying a natural gas stream, and more specifically to a process for conveying a natural gas stream through a pipeline to a liquefication plant which produces a pressurized liquefied natural gas (PLNG) for further conveyance.

BACKGROUND OF THE INVENTION

Because of its clean burning qualities and convenience, natural gas has become widely used in recent years. Many sources of natural gas are located in remote areas, great distances from any commercial markets for the gas. Sometimes a pipeline is available for transporting produced natural gas to a commercial market. Although the transportation of gas by pipeline normally takes place over fairly lengthy distances, this would be no problem where only transportation over land is encountered. However, in many instances the natural gas is separated from a suitable market by expansive bodies of water. When pipeline transportation is not feasible, produced natural gas is often processed into liquefied natural gas (which is called "LNG") for transport to market. The liquefication plants are sometimes located at the source of the LNG, but the LNG plants are often located at ports from which the liquefied gas is shipped to foreign markets.

One of the distinguishing features of natural gas transportation systems is the large capital investment required. Pipelines, plants used to liquefy natural gas, and ships to carry the liquefied natural gas are all quite expensive. Pipeline materials and installation cost can be quite high and gas compressors and cooling systems arc required to move the gas through the pipeline. The liquefication plant is made up of several basic systems, including gas treatment to remove impurities, liquefication, refrigeration, power facilities, and storage and ship loading facilities. The design and operation of these systems can significantly increase the transportation cost of the natural gas. These systems can make transportation of the natural gas in some locations in the world economically prohibitive.

The development of natural gas fields in arctic regions, such as the North Slope gas and oil fields of the State of Alaska, present special challenges. The natural gas pipelines that are buried in frozen soil or permafrost must be taken into account. If such pipelines arc transmitting gas at temperatures above 0° C. (32° F.), the frozen ground in which the pipelines are buried will eventually thaw, and the resulting settlement or heaving action could possibly cause pipeline failure. Accordingly, preservation of the frozen soil or permafrost is a major concern to pipeline installers and operators, not only with a view to protecting the environment, but also with a view to minimizing damage and failure of the pipelines.

Various pipelines systems for conveying the natural gas in arctic environments have been suggested. U.S. Pat. No. 4,192,655 to von Linde discloses one example of a pipeline system for transporting natural gas over long distances in arctic regions by a pipeline to a liquefication plant at a port. The von Linde patent suggests using a pipeline having a number of sections in series with intermediate compressor stations. The pressure and temperature of the gas at the entry to each pipeline section is such that the drop in pressure of the gas in each section creates a drop in gas temperature and this low temperature gas is used to re-cool the gas heated by compression before it enters the next pipeline section. Von Linde suggests conveying the gas at an initial pressure of between 7,500 kPa (1,088 psia) and 15,000 kPa (2,175 psia) and at an initial temperature of below −10° C. (14° F.). The gas exiting the last pipeline section can be −45.2° C. (−50° F.) or lower. The liquefication plant, being located at the end of the last pipeline section, takes advantage of the low temperature in the liquefication process. From the liquefication plant the liquefied gas is pumped into tankers for transport to market.

Conventional gas liquefaction processes are required to produce a liquefied product that is below about −156.7° C. (−250° F.) for transportation via ships to the customer. As a result, more of the gas is consumed in the $CO_2$ removal, gas liquefaction, and liquid regasification processes, thereby making less of the gas available to the consumer as product. In addition, gas transportation to the liquefaction facilities in conventional steel pipelines limits the practical (economical) operating pressure of conventional pipelines to pressures in the range of 6,895 to 15,860 kPa (1,000 to 2,300 psia), thereby requiring the use of gas recompressor stations along the pipeline route. The pipeline recompressors consume additional fuel and add heat of compression to the gas in the pipeline, so that the gas reaches the liquefaction plant at a warmer temperature than it would if pipeline recompression were not required.

The industry has a continuing need for an improved process for conveying natural gas which minimizes the amount of treating equipment required and the overall power consumption. By reducing the overall cost of conveying natural gas over long distances will add to the amount of gas available for use by consumers.

SUMMARY

This invention relates to an improved process for conveying gas stream rich in methane, such as natural gas. In the first step of the process, gas is supplied to a pipeline at an entry pressure that is substantially higher than the output pressure of the pipeline. The drop in pressure in the pipeline causes a lowering of the gas temperature, preferably to a temperature below about −29° C. (−20° F.). The entry pressure of the gas to the pipeline is controlled to achieve a predetermined output pressure of the gas from the pipeline. Output gas from the pipeline is then liquefied to produce liquefied gas having a temperature above about −112° C. (−170° F.) and a pressure sufficient for the liquid to be at or below its bubble point temperature. The pressurized liquefied gas is then further transported in a suitable container.

The liquefaction plant receives the natural gas at a temperature below about −29° C. (−20° F.) and a pressure above about 3,450 kPa (500 psia). The natural gas is then introduced to a first phase separator to produce a first liquid stream and a first vapor stream. The pressure of the first liquid stream is adjusted to approximately the operating pressure of a third phase separator used in the process. This pressure adjusted liquid stream is passed to the third phase separator. The first vapor stream is passed through a first heat exchanger, thereby warming the first vapor stream. The first vapor stream is compressed and cooled. The compressed first vapor stream is passed through the first heat exchanger to further cool the compressed first vapor stream. The compressed vapor stream is passed through a second heat exchanger to still further cool the first vapor stream. This compressed vapor stream is expanded to thereby decreasing its temperature. This expanded stream is then passed to a second phase separator to produce a second vapor stream and a second liquid stream. The second vapor stream is recycled back to the first phase separator. The second liquid stream is expanded to further reduce the pressure and lower the temperature. The second liquid stream is passed to a third phase separator to produce a third vapor stream and a liquid product stream having a temperature above −112° C. (−170° F.) and having a pressure sufficient for the liquid to be at or below its bubble point. The third vapor stream is passed through the second heat exchanger to provide refrigeration to the second heat exchanger. The third vapor stream is passed through a third heat exchanger, the third vapor stream is compressed to approximately the operating pressure of the first phase separator, the compressed third vapor stream is cooled, and the cooled compressed third vapor stream is passed through the third heat exchanger and the compressed third vapor stream is passed to the first phase separator for recycling.

In the practice of this invention, natural gas can be transported at higher pressure (17,238 to 34,475 kPa) without the requirement of pipeline recompressor stations, thereby avoiding the addition of recompression heat along the pipeline. The natural gas arrives at the liquefaction plant at a colder temperature, which lessens the amount of refrigeration needed to liquefy the gas and it also lessens the amount of gas consumed as fuel in the liquefaction plant.

BRIEF DESCRIPTION OF THE DRAWINGS

The present invention and its advantages will be better understood by referring to the following detailed description and the attached Figures.

The Figures present two embodiments of practicing the process of this invention. The Figures are not intended to exclude from the scope of the invention other embodiments that are the result of normal and expected modifications of these specific embodiments. Various required subsystems such as valves, control systems, sensors, clamps, and riser support structures have been deleted from the Figures for the purposes of simplicity and clarity of presentation.

DESCRIPTION OF THE INVENTION

The present invention is an improved process for conveying natural gas over long distance by first passing the natural gas through a pipeline and then liquefying the gas in a liquefication plant to produce a methane-rich liquid product having a temperature above about −112° C. (−170° F.) and a pressure sufficient for the liquid product to be at or below its bubble point temperature. This methane-rich product is sometimes referred to in this description as pressurized liquid natural gas ("PLNG"). The term "bubble point" is the temperature and pressure at which a liquid begins to convert to gas. For example, if a certain volume of PLNG is held at constant pressure, but its temperature is increased, the temperature at which bubbles of gas begin to form in the PLNG is the bubble point. Similarly, if a certain volume of PLNG is held at constant temperature but the pressure is reduced, the pressure at which gas begins to form defines the bubble point. At the bubble point, the mixture is saturated liquid.

The gas liquefication process of the present invention requires less total power for transporting through a pipeline and then liquefying the natural gas in a liquefication plant than processes used in the past and the equipment used in the process of this invention can be made of less expensive materials. By contrast, prior art processes that produce conventional LNG at atmospheric pressures having temperatures as low as −160° C. (−256° F.) require process equipment made of expensive materials for safe operation. The invention is particularly useful in arctic applications, but the invention can also be used in warm climates.

The energy needed for liquefying the natural gas in the practice of this invention is greatly reduced over energy requirements of a conventional LNG plant which produces LNG at atmospheric pressure and a temperature of about −160° C. (−256 ° F.). The reduction in necessary refrigeration energy required for the process of the present invention results in a large reduction in capital costs, proportionately lower operating expenses, and increased efficiency and reliability, thus greatly enhancing the economics of producing liquefied natural gas.

Figure 1:
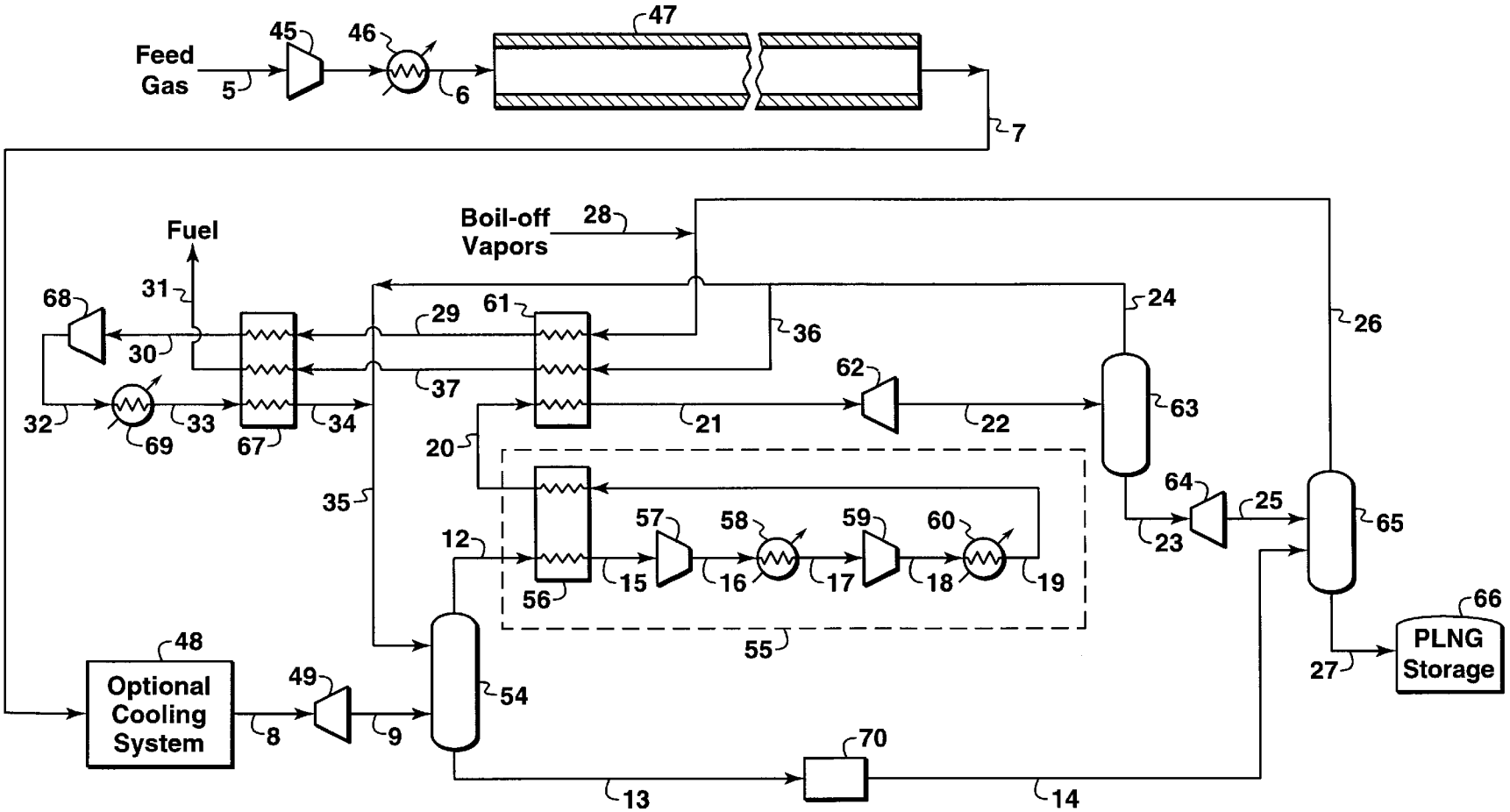
FIG. 1 is a schematic diagram of one embodiment of the liquefaction process of the present invention.

Referring to FIG. 1, a feed gas produced from a natural gas reservoir, from associated gas from oil production or from any other suitable source is fed as stream 5 to a compression zone 45 comprising one or more compressors. Although not shown in the FIG. 1, before the feed gas is passed to the compressors, the feed gas will normally have passed through treatment stage to remove contaminants.

The first consideration in cryogenic processing of natural gas is contamination. The raw natural gas feed stock suitable for the process of this invention may comprise natural gas obtained from a crude oil well (associated gas) or from a gas well (non-associated gas). The composition of natural gas can vary significantly. As used herein, a natural gas stream contains methane ($C_1$) as a major component. The natural gas will typically also contain ethane ($C_2$), higher hydrocarbons ($C_{3+}$), and minor amounts of contaminants such as water, carbon dioxide, hydrogen sulfide, nitrogen, butane, hydrocarbons of six or more carbon atoms, dirt, iron sulfide, wax, mercury, helium, and crude oil. The solubilities of these contaminants vary with temperature, pressure, and composition. At cryogenic temperatures, $CO_2$, water, or other contaminants can form solids, which can plug flow passages in cryogenic heat exchangers. These potential difficulties can be avoided by removing such contaminants if conditions within their pure component, solid phase temperature-pressure phase boundaries are anticipated. In the following description of the invention, it is assumed that the natural gas stream being fed to the compressor zone 45 has been suitably treated to remove unacceptably high levels of sulfides and carbon dioxide and dried to remove water using conventional and well-known processes to produce a "sweet, dry" natural gas stream. If the natural gas stream contains heavy hydrocarbons that could freeze out during liquefication or if the heavy hydrocarbons are not desired in PLNG, the heavy hydrocarbon may be removed by a fractionation process prior to liquefaction of the natural gas. At the operating pressures and temperatures of PLNG, moderate amounts of nitrogen in the natural gas can be tolerated since the nitrogen will remain in the liquid phase with the PLNG.

After being compressed in compression zone 45, the natural gas is preferably passed through an aftercooler 46 to cool the gas stream by indirect heat exchange before the gas enters pipeline 47. Aftercooler 46 may be any conventional cooling system that cools the natural gas to a temperature below about −1.1° C. (30° F.) for applications in which the pipeline will be buried in frozen soil or permafrost. Aftercooler 46 preferably comprises a combination of air or water-cooled heat exchangers and a conventional closed-cycle propane refrigeration system.

The natural gas is compressed by compression zone 45 to a pressure sufficient to produce a predetermined pressure and temperature at the output of the pipeline (stream 7). The pressure of the natural gas at the entry to the pipeline (stream 6) is controlled so that lowering of natural gas temperatures results from the Joule-Thomson effect created by the drop in pressure in the pipeline. The gas pressure at the entry to the pipeline can be determined by those skilled in the art taking into account the length of the pipeline, gas flow rate, and frictional losses incurred in conveyance of the gas through the pipeline. The pressure of the entry gas (stream 6) will preferably range between about 17,238 kPa (2,500 psia) and about 48,265 kPa (7,000 psia), and more preferably between 20,685 kPa (3,000 psia) and 24,133 kPa (3,500 psia).

The pipeline, which may be composed of alloy steel, is preferably provided with thermal insulation which is designed to ensure that temperature of the output gas is lower than the temperature of the input gas. Suitable insulating materials are well known to those skilled in the art. The pipeline metal is preferably a high-strength, low-alloy steel containing less than about three weight percent nickel and having strength and toughness for containing the natural gas at the operating conditions of this invention. Example steels for use in constructing the pipeline of this invention are described in U.S. Pat. Nos. 5,531,842; 5,545,269; and 5,545,270.

The pipeline 47 may be buried in the ground or in the sea floor, or laid on the ground or sea floor, or elevated above the ground or sea floor, or any combination of the foregoing, depending on where the gas is being transported.

The pressure of the pipeline output gas (stream 7) preferably ranges between about 3,450 kPa (500 psia) and 10,340 kPa (1,500 psia), and more preferably between about 3,790 kPa (550 psia) and 8,620 kPa (1,250 psia). If the output gas pressure is below about 500 psia, the gas pressure can be pressurized by a suitable compression means (not shown), which may comprise one or more compressors that compress the gas to at least 500 psia before the gas enters the liquefaction plant. The temperature of the natural gas output from pipeline 47 preferably ranges between about −29° C. (−20° F.) and −73° C. (−100° F.), and more preferably between about 29° C. (−20° F.) and −62° C. (−80° F.). Although the output gas from the pipeline may be introduced directly to phase separator 54, the pipeline output gas is preferably further cooled by an external refrigeration system and it is preferably still further cooled by pressure expansion. As shown the FIG. 1, the pipeline output gas is preferably cooled by a cooling system 48 which may comprise any conventional closed-circuit refrigeration system, preferably a closed-cycle propane refrigeration system, and more preferably a closed-cycle refrigeration system containing a mixture of $C_1$, $C_2$, $C_3$, $C_4$, and $C_5$ as a refrigerant. The output from the cooling system 48 is further cooled by an expander zone 49 which comprises a mechanical expander or a throttling valve, or both, to achieve a predetermined final output pressure and temperature. Expander zone 49, preferably comprising one or more turboexpanders, which at least partially liquefies the gas stream.

The metallurgy, diameter, and operating pressure of pipeline 47 and the gas feed conditions (stream 6) to the pipeline 47 can be optimized by those skilled in the art in view of the teachings of this description to eliminate costly pipeline recompression systems and thereby minimize the overall cost of the pipeline system. The temperature and pressure conditions for the cooling system 48 and the expander zone 49 can also be optimized by those skilled in the art taking in account the teaching of this description to fully use the Joule-Thomson cooling in the pipeline 47 and thereby maximize the gas volume available to consumers.

Natural gas introduced to phase separator 54 is separated into a liquid stream 13 and a vapor stream 12. The liquid stream 13 will typically need to be pressure regulated in pressure adjustment zone 70 to a pressure approximately the same as the operating pressure of the phase separator 65. In most applications of this invention, the pressure of stream 13 will not be the same as the operating pressure of phase separator 65. If the pressure of stream 13 is less than the operating pressure of separator 65, pressure adjustment zone 70 preferably comprises a pump to increase the pressure of stream 13 to approximately the same pressure of fluid in separator 65. If the pressure of stream 13 is greater than the operating pressure of separator 65, pressure adjustment zone 70 preferably comprises an expander, such as a hydraulic turbine, to lower the pressure to the pressure of fluid in separator 65.

The vapor stream 12 from the phase separator 54 is passed to a compression zone 55 to pressurize stream 12. The compression zone preferably comprises a heat exchanger 56 through which stream 12 is warmed before passing as stream 15 to at least two compressors 57 and 59, with at least one heat exchanger 58 between compressors 57 and 59 and one at least one heat exchanger 60 after the last compressor 69. The vapor stream 19 exiting heat exchanger 60 is passed through heat exchanger 56 to be further cooled by indirect heat exchange with the incoming vapor stream 12.

This invention is not limited to any type of heat exchanger, but because of economics, plate-fin, spiral wound, and cold box heat exchangers are preferred, which all cool by indirect heat exchange. The term "indirect heat exchange," as used in this description and claims, means the bringing of two fluid streams into heat exchange relation without any physical contact or intermixing of the fluids with each other.

From the compression zone 55, the compressed gas stream 20 passes through heat exchanger 61 which is cooled with overhead vapor stream 26 from the phase separator 65. From the heat exchanger 61, stream 21 then passes through an expander zone 62, preferably one or more hydraulic turbines to reduce the pressure and temperature of the gas stream and thereby at least partially liquefying the gas stream. The at least partially liquefied gas (stream 22) then passes to phase separator 63 which separates the liquid and vapor, producing vapor stream 24 and liquid stream 23. A fraction of vapor stream 24 is returned to the phase separator 54 for recycling. A second fraction of stream 24 is withdrawn as stream 36 and passed through heat exchanger 61 to heat stream 36. From the heat exchanger 61, the heated stream (stream 37) is further heated by heat exchanger 67 to produce a heated stream 31 suitable for use as fuel. This fuel may provide energy for powering turbines that partially power the compressors in compression zone 55.

The liquid stream 23 produced by separator 63 is passed to another expander zone 64, preferably one hydraulic turbine, to further reduce the pressure and temperature of the liquid stream. Stream 25 from the expander zone 64 then passes to phase separator 65. The expanders of expander zones 62 and 64 are preferably used to provide at least part of the power for the compressors 57 and 59.

Phase separator 65 produces a vapor stream 26 and a liquid stream 27. The liquid stream 27 passes to a suitable container such as a stationary storage vessel or a suitable carrier such as a ship, barge, submarine vessel, railroad tank car, or truck. In accordance with the practice of this invention, liquid stream 27 will have a temperature above about −112° C. (−170° F.) and a pressure sufficient for the liquid to be at or below its bubble point.

The vapor stream 26 passes through heat exchanger 61 to provide cooling to vapor stream 20 by indirect heat exchange. From heat exchanger 61, stream 29 passes through another heat exchanger 67 and is then compressed by compressor 68 to a pressure approximately the same as the pressure of phase separator 54. The compressed gas (stream 32) is then cooled in a conventional aftercooler 69 by air or water, and then further cooled by heat exchanger 34 before being combined with stream 24 and returned to phase separator 54 for recycling.

In the storage, transportation, and handling of liquefied natural gas, there can be a considerable amount of boil-off vapor resulting from evaporation. The process of this invention can optionally liquefy the boil-off gas. Referring to FIG. 1, the boil-off vapor 28 is preferably introduced to the liquefication process by being combined with vapor stream 26. Although not shown in FIG. 1, the boil-off vapor preferably is introduced to the process at the same pressure as stream 26. Although not shown in FIG. 1, the boil-off gas will typically need to be pressurized by a compressor or de-pressurized by an expander before being introduced to stream 26.

Figure 2:
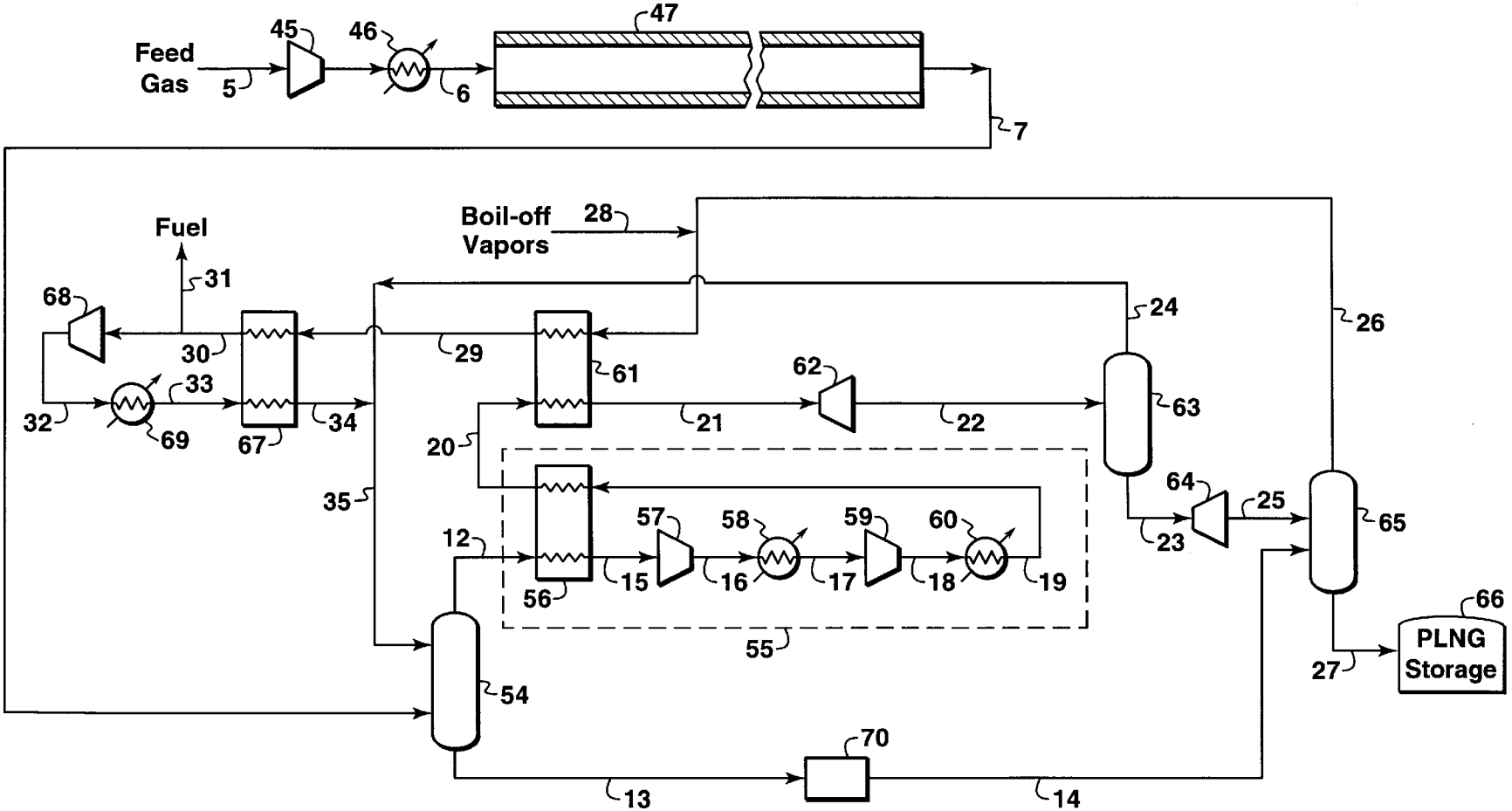
FIG. 2 is a schematic diagram of a second embodiment of the liquefaction process of the present invention.

FIG. 2 illustrates another embodiment of this invention, and in this embodiment the parts having like numerals to those in FIG. 1 have the same process functions. Those skilled in the art will recognize, however, that the process equipment from one embodiment to another may vary in size and capacity to handle different fluid flow rates, temperatures, and compositions. The embodiment of FIG. 2 is similar to the embodiment of FIG. 1 except that the cooling zone 48 and expansion zone 49 of FIG. 1 are not used in the embodiment of FIG. 2 and in FIG. 2 the fuel gas (stream 31) is withdrawn from vapor overhead of separator 65 whereas in FIG. 1 fuel gas (stream 38) is withdrawn from vapor overhead of separator 63.

To minimize compression power required for liquefaction when appreciable nitrogen exists in natural gas feed stream 5 and/or in the boil-off vapor stream 28, the nitrogen concentration is preferably concentrated and removed at some location in the process. The process of this invention concentrates nitrogen as vapor streams 24 and 26, with vaporous stream 24 having a higher concentration of nitrogen than vaporous stream 26. In FIG. 1, a portion of vapor stream 24 is removed as a fuel gas (stream 31) and in FIG. 2 a portion of vapor stream 26 is removed as fuel gas.

EXAMPLE

A simulated mass and energy balance was carried out to illustrate the embodiment illustrated in the Figures, and the results are set forth in Tables 1 and 2 below. Table 1 corresponds to the embodiment shown in FIG. 1 and Table 2 corresponds to the embodiment shown in FIG. 2. The temperatures, pressures, and flow rates presented in the Tables are not to be considered as limitations upon the invention which can have many variations in temperatures and flow rates in view of the teachings herein.

In both simulations, it was assumed that natural gas was fed to a 284 mile, 21 inch pipeline that was buried in permafrost in the North Slope of Alaska. In the first simulation (Table 1), it was assumed that the gas composition comprised 85.9 mole percent methane, 13.5 mole percent ethane and heavier hydrocarbons, 100 parts per million $CO_2$, and 0.6 mole percent $N_2$. In the second simulation (Table 2), it was assumed that the gas composition comprised 94.5 mole percent methane, 5 mole percent ethane and heavier hydrocarbons, 100 parts per million $CO_2$ and 0.5 mole percent $N_2$.

In the first simulation, the pipeline inlet pressure (stream 6 of FIG. 1) was assumed to be 22,754 kPa (3,300 psia) In the second simulation, the pipeline inlet pressure (stream 6 of FIG. 2) was assumed to be 48,266 kPa (7,000 psia). FIG. 2 is optimum when the overall cost of the pipeline system is minimized for 3,450 kPa (500 psia) delivery with a starting pressure of 48,266 kPa (7,000 psia).

The data were obtained using a commercially available process simulation program called HYSYS™, marketed by Hyprotech Ltd. of Calgary, Canada; however, other commercially available process simulation programs can be used to develop the data, including for example HYSIM™, PROII™, and ASPEN PLUS™, all of which are familiar to those of ordinary skill in the art.

A person skilled in the art, particularly one having the benefit of the teachings of this patent, will recognize many modifications and variations to the specific processes disclosed above. For example, a variety of temperatures and pressures may be used in accordance with the invention, depending on the overall design of the system and the composition of the feed gas. Also, the feed gas cooling train may be supplemented or reconfigured depending on the overall design requirements to achieve optimum and efficient heat exchange requirements. As discussed above, the specifically disclosed embodiments and examples should not be used to limit or restrict the scope of the invention, which is to be determined by the claims below and their equivalents.

TABLE 1

| | | | | | | | | Composition | | | |
|---|---|---|---|---|---|---|---|---|---|---|---|
| Stream | Phase | Pressure kPa | Pressure psia | Temp. Deg C. | Temp. Deg F. | Flowrate KgMol/hr | Flowrate #mol/hr | $C_1$ mol % | $C_{2+}$ mol % | $CO_2$ ppmv | $N_2$ mol % |
| 6 | vapor | 22,754 | 3,300 | −0.8 | 30.0 | 37,534 | 82,747 | 85.9 | 13.5 | 100 | 0.6 |
| 7 | vapor | 8,619 | 1,250 | −29.2 | −21.1 | 37,534 | 82,747 | 85.9 | 13.5 | 100 | 0.6 |
| 9 | vapor/liquid | 3,517 | 510 | −65.2 | −85.9 | 37,534 | 82,747 | 85.9 | 13.5 | 100 | 0.6 |
| 12 | vapor | 3,517 | 510 | −68.6 | −92.0 | 54,523 | 120,200 | 94.3 | 4.1 | 64 | 1.6 |
| 13 | liquid | 3,517 | 510 | −68.6 | −92.0 | 6,904 | 15,220 | 55.7 | 44.1 | 133 | 0.2 |
| 14 | vapor/liquid | 2,675 | 388 | −76.3 | −106.0 | 6,904 | 15,220 | 55.7 | 44.1 | 133 | 0.2 |
| 15 | vapor | 3,496 | 507 | 13.7 | 56.0 | 54,523 | 120,200 | 94.3 | 4.1 | 64 | 1.6 |
| 16 | vapor | 7,240 | 1,050 | 79.8 | 175.1 | 54,523 | 120,200 | 94.3 | 4.1 | 64 | 1.6 |

TABLE 1-continued

| Stream | Phase | Pressure kPa | Pressure psia | Temp. Deg C. | Temp. Deg F. | Flowrate KgMol/hr | Flowrate #mol/hr | Composition $C_1$ mol % | $C_{2+}$ mol % | $CO_2$ ppmv | $N_2$ mol % |
|---|---|---|---|---|---|---|---|---|---|---|---|
| 17 | vapor | 7,205 | 1,045 | 15.9 | 60.0 | 54,523 | 120,200 | 94.3 | 4.1 | 64 | 1.6 |
| 18 | vapor | 24,133 | 3,500 | 127.7 | 261.2 | 54,523 | 120,200 | 94.3 | 4.1 | 64 | 1.6 |
| 19 | vapor | 24,064 | 3,490 | 15.9 | 60.0 | 54,523 | 120,200 | 94.3 | 4.1 | 64 | 1.6 |
| 20 | vapor | 24,043 | 3,487 | −42.7 | −45.4 | 54,523 | 120,200 | 94.3 | 4.1 | 64 | 1.6 |
| 21 | vapor | 24,009 | 3,482 | −51.2 | −60.7 | 54,523 | 120,200 | 94.3 | 4.1 | 64 | 1.6 |
| 22 | vapor/liquid | 3,517 | 510 | −89.5 | −129.7 | 54,523 | 120,200 | 94.3 | 4.1 | 64 | 1.6 |
| 23 | liquid | 3,517 | 510 | −89.5 | −129.7 | 40,860 | 90,080 | 93.7 | 5.2 | 76 | 1.1 |
| 24 | vapor | 3,517 | 510 | −89.5 | −129.7 | 13,313 | 29,350 | 96.2 | 0.8 | 29 | 3.0 |
| 25 | vapor/liquid | 2,620 | 380 | −98.3 | −145.5 | 41,187 | 90,800 | 93.7 | 5.2 | 76 | 1.1 |
| 26 | vapor | 2,620 | 380 | −95.7 | −140.9 | 8,777 | 19,350 | 96.5 | 0.7 | 25 | 2.8 |
| 27 | liquid | 2,620 | 380 | −95.7 | −140.9 | 39,314 | 86,670 | 86.4 | 13.0 | 97 | 0.6 |
| 28 | vapor | 2,658 | 386 | −94.1 | −138.0 | 2,780 | 6,129 | 97.2 | 1.0 | 33 | 1.8 |
| 29 | vapor | 2,586 | 375 | −44.6 | −48.9 | 11,558 | 25,480 | 96.6 | 0.8 | 27 | 2.6 |
| 30 | vapor | 2,565 | 372 | 11.4 | 52.0 | 11,558 | 25,480 | 96.6 | 0.8 | 27 | 2.6 |
| 32 | vapor | 3,585 | 520 | 41.3 | 105.8 | 11,558 | 25,480 | 96.6 | 0.8 | 27 | 2.6 |
| 33 | vapor | 3,565 | 517 | 15.9 | 60.0 | 11,558 | 25,480 | 96.6 | 0.8 | 27 | 2.6 |
| 34 | vapor | 3,544 | 514 | −42.4 | −44.9 | 11,558 | 25,480 | 96.6 | 0.8 | 27 | 2.6 |
| 35 | vapor | 3,517 | 510 | −70.3 | −95.1 | 23,873 | 52,630 | 96.4 | 0.8 | 28 | 2.8 |
| 37 | vapor | 3,517 | 505 | −44.6 | −48.9 | 998 | 2,200 | 96.2 | 2.8 | 29 | 3 |
| 38 | vapor | 3,461 | 502 | 11.4 | 52.0 | 16,488 | 36,350 | 96.2 | 0.8 | 29 | 3.0 |

TABLE 2

| Stream | Phase | Pressure kPa | Pressure psia | Temp. Deg C. | Temp. Deg F. | Flowrate KgMol/hr | Flowrate Lb mol/hr | Composition $C_1$ mol % | $C_{2+}$ mol % | $CO_2$ ppmv | $N_2$ mol % |
|---|---|---|---|---|---|---|---|---|---|---|---|
| 6 | vapor | 48,266 | 7,000 | −0.8 | 30.0 | 34,750 | 76,610 | 94.5 | 5.0 | 100 | 0.6 |
| 9 | vapor/liquid | 3,448 | 500 | −76.2 | −105.8 | 34,750 | 76,610 | 94.5 | 5.0 | 100 | 0.6 |
| 12 | vapor | 3,448 | 500 | −76.2 | −105.8 | 49,715 | 109,600 | 96.3 | 2.7 | 75 | 1.0 |
| 13 | liquid | 3,448 | 500 | −76.2 | −105.8 | 1,383 | 3,048 | 65.0 | 34.8 | 189 | 0.2 |
| 14 | vapor/liquid | 2,675 | 388 | −83.8 | −119.4 | 1,383 | 3,048 | 65.0 | 34.8 | 189 | 0.2 |
| 15 | vapor | 3,427 | 497 | 9.8 | 49.0 | 49,715 | 109,600 | 96.3 | 2.7 | 75 | 1.0 |
| 16 | vapor | 7,240 | 1,050 | 77.8 | 171.4 | 49,715 | 109,600 | 96.3 | 2.7 | 75 | 1.0 |
| 17 | vapor | 7,205 | 1,045 | 11.4 | 52.0 | 49,715 | 109,600 | 96.3 | 2.7 | 75 | 1.0 |
| 18 | vapor | 24,133 | 3,500 | 122.8 | 252.5 | 49,715 | 109,600 | 96.3 | 2.7 | 75 | 1.0 |
| 19 | vapor | 24,064 | 3,490 | 11.4 | 52.0 | 49,715 | 109,600 | 96.3 | 2.7 | 75 | 1.0 |
| 20 | vapor | 24,043 | 3,487 | −50.4 | −59.4 | 49,715 | 109,600 | 96.3 | 2.7 | 75 | 1.0 |
| 21 | vapor | 24,009 | 3,482 | −57.4 | −71.9 | 49,715 | 109,600 | 96.3 | 2.7 | 75 | 1.0 |
| 22 | vapor/liquid | 3,517 | 510 | −90.2 | −131.0 | 49,715 | 109,600 | 96.3 | 2.7 | 75 | 1.0 |
| 23 | liquid | 3,517 | 510 | −90.2 | −131.0 | 42,865 | 94,500 | 96.1 | 3.1 | 82 | 0.8 |
| 24 | vapor | 3,517 | 510 | −90.2 | −131.0 | 6,863 | 15,130 | 97.4 | 0.5 | 32 | 2.1 |
| 25 | vapor/liquid | 2,620 | 380 | −99.0 | −146.8 | 42,865 | 94,500 | 96.1 | 3.1 | 82 | 0.8 |
| 26 | vapor | 2,620 | 380 | −98.5 | −145.9 | 7,689 | 16,950 | 97.6 | 0.4 | 26 | 2.0 |
| 27 | liquid | 2,620 | 380 | −98.5 | −145.9 | 36,560 | 80,600 | 94.6 | 4.8 | 97 | 0.6 |
| 28 | vapor | 2,658 | 386 | −94.1 | −138.0 | 2,573 | 5,672 | 97.2 | 1.0 | 33 | 1.8 |
| 29 | vapor | 2,599 | 377 | −52.6 | −63.2 | 10,260 | 22,620 | 97.5 | 0.5 | 28 | 2.0 |
| 30 | vapor | 2,579 | 374 | 8.1 | 46.0 | 10,260 | 22,620 | 97.5 | 0.5 | 28 | 2.0 |
| 31 | vapor | 2,579 | 374 | 8.1 | 46.0 | 768 | 1,693 | 97.5 | 0.5 | 28 | 2.0 |
| 32 | vapor | 3,585 | 520 | 37.3 | 98.6 | 9,494 | 20,930 | 97.5 | 0.5 | 28 | 2.0 |
| 33 | vapor | 3,565 | 517 | 11.4 | 52.0 | 9,494 | 20,930 | 97.5 | 0.5 | 28 | 2.0 |
| 34 | vapor | 3,544 | 514 | −50.8 | −60.1 | 9,494 | 20,930 | 97.5 | 0.5 | 28 | 2.0 |
| 35 | vapor | 3,517 | 510 | −70.4 | −95.3 | 16,357 | 36,060 | 97.4 | 0.6 | 30 | 2.0 |

What is claimed is:

1. A process of conveying a gas rich in methane comprising the steps of:

(a) supplying gas to a pipeline at an entry pressure that is substantially higher than the output pressure of the pipeline, whereby lowering of gas temperature results from the Joule-Thomson effect created by the drop in pressure in the pipeline;

(b) controlling the entry pressure to achieve a predetermined output pressure of the pipeline;

(c) liquefying the output gas from the pipeline to produce liquefied gas having a temperature above about −112° C. (−170° F.) and a pressure sufficient for the liquid to be at or below its bubble point; and (d) further transporting the pressurized liquefied gas in a suitable container.

2. The process of claim 1 wherein the gas of the pipeline output has a temperature ranging between about −29° C. (−20° F.) and about −73° C. (−100° F.), and a pressure ranging between about 3,450 kPa (500 psia) and 10,340 kPa (1,500 psia).

3. The process of claim 2 wherein the gas temperature ranges between about −29° C. (−20° F.) and about −62° C. (−80° F.).

4. The process of claim 2 wherein the gas pressure ranges between 3,450 kPa (500 psia) and 4,137 kPa (600 psia).

5. The process of claim 1 further comprising before step (a) the additional steps of compressing the gas to a predetermined pressure, and thereafter cooling the gas by means of a closed-loop refrigeration system.

6. The process of claim 1 further comprising after step (b) and before step (c) the additional step of cooling the output gas from the pipeline.

7. The process of claim 6 wherein the additional cooling step comprises cooling the output gas by means of a closed-loop refrigeration system and thereafter expanding the gas cooled by the closed-loop refrigeration system to decrease the pressure and to further reduce the temperature.

8. The process of claim 1 further comprises transporting the pressurized liquid gas by means of a ship.

9. The process of claim 1 wherein the gas is natural gas.

10. The process of claim I wherein the output gas from the pipeline is substantially free of carbon dioxide.

11. The process of claim 1 wherein the gas supplied to the pipeline is substantially free of hydrocarbons having more than two carbon atoms.

12. The process of claim 2 wherein the liquefaction of the pipeline gas in step (c) of claim 1 comprises the steps of:

(e) introducing the pipeline output gas to a first phase separator to produce a first liquid stream and a first vapor stream;

(f) adjusting the pressure of the liquid stream to approximately the operating pressure of the third phase separator of step (p) below;

(g) passing the pressure adjusted liquid stream to the third phase separator;

(h) passing the first vapor stream through a first heat exchanger, thereby warming the first vapor stream;

(I) compressing and cooling the first vapor stream;

(j) passing the compressed and cooled first vapor stream through the first heat exchanger to further cool the compressed first vapor stream;

(k) passing the compressed first vapor stream of step (f) through a second heat exchanger to still further cool the first vapor stream;

(l) expanding the vapor stream of step (g) to decrease the pressure and to reduce the temperature;

(m) passing the expanded stream to a second phase separator to produce a second vapor stream and a second liquid stream;

(n) recycling the second vapor stream back to the first phase separator;

(o) expanding the second liquid stream to further reduce the pressure and lower the temperature;

(p) passing the second liquid stream to a third phase separator to produce a third vapor stream and a liquid product stream having a temperature above −112° C. (−170° F.) and having a pressure sufficient for the liquid to be at or below its bubble point;

(q) passing the third vapor stream through the second heat exchanger to provide refrigeration to the second heat exchanger; and (r) passing the third vapor stream through a third heat exchanger, compressing third vapor stream to approximately the operating pressure of the first phase separator, cooling the compressed third vapor stream, and passing cooled compressed third vapor stream through the third heat exchanger and passing compressed third vapor stream to the first phase separator for recycling.

13. The process of claim 12 further comprising cooling the first vapor stream in step (I) by indirect heat exchange with water or air.

14. The process of claim 12 further comprising after the third vapor stream of step (r) passes through the third heat exchanger the additional step of withdrawing a portion of the third vapor stream as fuel.

15. The process further comprising withdrawing a portion of the second vapor stream of step (g) of claim 12 and passing the withdrawn vapor stream through the second heat exchanger and the third heat exchanger to heat the withdrawn vapor stream and removing the heated withdrawn vapor stream as fuel.

16. The process of claim 12 further comprising before step (e) the additional step of cooling the output gas from the pipeline.

17. The process of claim 12 wherein the gas steam contains methane and hydrocarbon components heavier than methane, further comprising prior to step (e) the additional step of removing a predominant portion of the heavier hydrocarbons by fractionation.

18. The process of claim 12 wherein the process further comprises the additional step of introducing to the third vapor stream a pressurized boil-off gas resulting from evaporation of liquefied natural gas.

19. The process of claim 18 wherein the pressurized boil-off gas has a pressure above 250 psia and a temperature above −112° C. (−170° F.).

20. A process for liquefying a pressurized methane-rich gas stream comprising the steps of:

(a) cooling at least a portion of the methane-rich gas stream by passing the portion through at least one heat exchanger refrigerated by a closed-loop refrigeration system;

(b) further cooling the feed stream by pressure expansion through a pipeline;

(c) liquefying the cooled gas of step (b) in a liquefaction plant to produce to produce a liquefied gas having a temperature above about −112° C. (−170° F.) and a pressure sufficient for the liquid to be at or below its bubble point; and (d) further transporting in a suitable container the liquefied gas of step (c).

21. A process for liquefying a pressurized gas stream rich in methane having a temperature between about −29° C. (−20° F.) and about −73° C. (−100° F.) and a pressure ranging between about 1,380 kPa (200 psia) and about 6,895 kPa (1,000 psia), comprising the steps of:

(a) introducing the pressurized gas stream to a first phase separator to produce a first liquid stream and a first vapor stream;

(b) adjusting the pressure of the liquid stream to approximately the operating pressure of the third phase separator of step (1) below;

(c) passing the pressure adjusted liquid stream to the third phase separator;

(d) passing the first vapor stream through a first heat exchanger, thereby warming the first vapor stream;

(e) compressing and cooling the first vapor stream;

(f) passing the compressed first vapor stream through the first heat exchanger to further cool the compressed first vapor stream;

(g) passing the compressed vapor stream through a second heat exchanger to still further cool the first vapor stream;

(h) expanding the gas stream of step (g) to decrease the pressure and to reduce the temperature;

(i) passing the expanded stream to a second phase separator to produce a second vapor stream and a second liquid stream;

(j) recycling the second vapor stream back to the first phase separator;

(k) expanding the second liquid stream to further reduce the pressure and lower the temperature;

(l) passing the second liquid stream to a third phase separator to produce a third vapor stream and a liquid product stream having a temperature above −112° C. (−170° F.) and having a pressure sufficient for the liquid to be at or below its bubble point;

(m) passing the third vapor stream through the second heat exchanger to provide refrigeration to the second heat exchanger; and (n) passing the third vapor stream through a third heat exchanger, compressing third vapor stream to approximately the operating pressure of the first phase separator, cooling the compressed third vapor stream, and passing cooled compressed third vapor stream through the third heat exchanger and passing compressed third vapor stream to the first phase separator for recycling.

22. The process of claim 21 further comprises, before step (a), expanding the pressurized gas stream to a lower pressure to produce a gas stream and a liquid product having a temperature between about −40° C. (−170° F.) and about −73° C. (−100° F.).

* * * * *